United States Patent [19]

Sisko et al.

[11] 4,262,890

[45] Apr. 21, 1981

[54] SKI HOLDER

[76] Inventors: Paul Sisko, 161 Main St., Ridgefield Park, N.J. 07660; Robert Lehman, 99 Lloyd Rd., Montclair, N.J. 07042

[21] Appl. No.: 129,113

[22] Filed: Mar. 10, 1980

[51] Int. Cl.[3] ..... B25B 11/00

[52] U.S. Cl. ..... 269/21; 269/97; 269/296; 269/906; 248/206 R; 248/362; 248/363

[58] Field of Search ..... 269/21, 22, 97, 98, 269/296, 321 W; 248/206 R, 362, 363

[56] References Cited

U.S. PATENT DOCUMENTS

| | | | |
|---|---|---|---|
| 3,854,712 | 12/1974 | McGee | 269/321 W |
| 3,861,664 | 1/1975 | Durkee | 269/321 W |
| 3,977,663 | 8/1976 | Köhler et al. | 269/321 W |

FOREIGN PATENT DOCUMENTS

| | | | |
|---|---|---|---|
| 1060196 | 3/1954 | France | 248/206 R |
| 435981 | 10/1935 | United Kingdom | 248/362 |

*Primary Examiner*—Robert C. Watson

*Attorney, Agent, or Firm*—Holland, Armstrong, Wilkie & Previto

[57] ABSTRACT

A holder is described for temporarily mounting a ski on a work surface for permitting the ski to be tuned or otherwise routinely maintained by filing the ski edges and bottoms and for coating the ski bottoms etc. Each holder has a threaded clamp for mounting it on a work table or other convenient surface and has a pivotally mounted vacuum ski engaging device at its top for removably engaging the ski. Two of these holders firmly position a ski on the work surface for the ski tuning operation.

5 Claims, 3 Drawing Figures

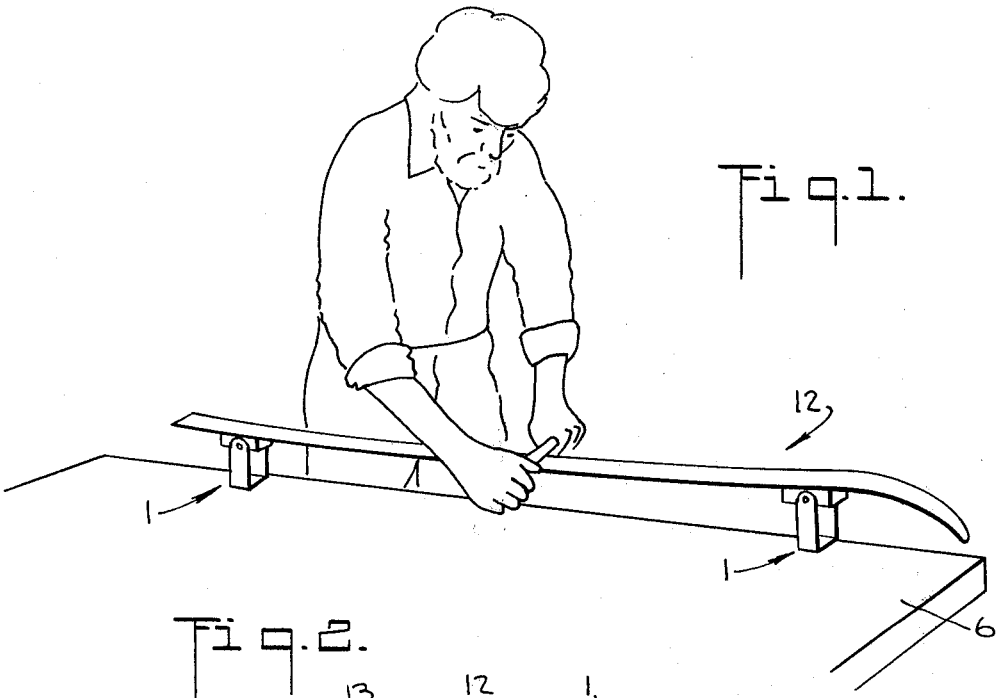
Fig. 1.
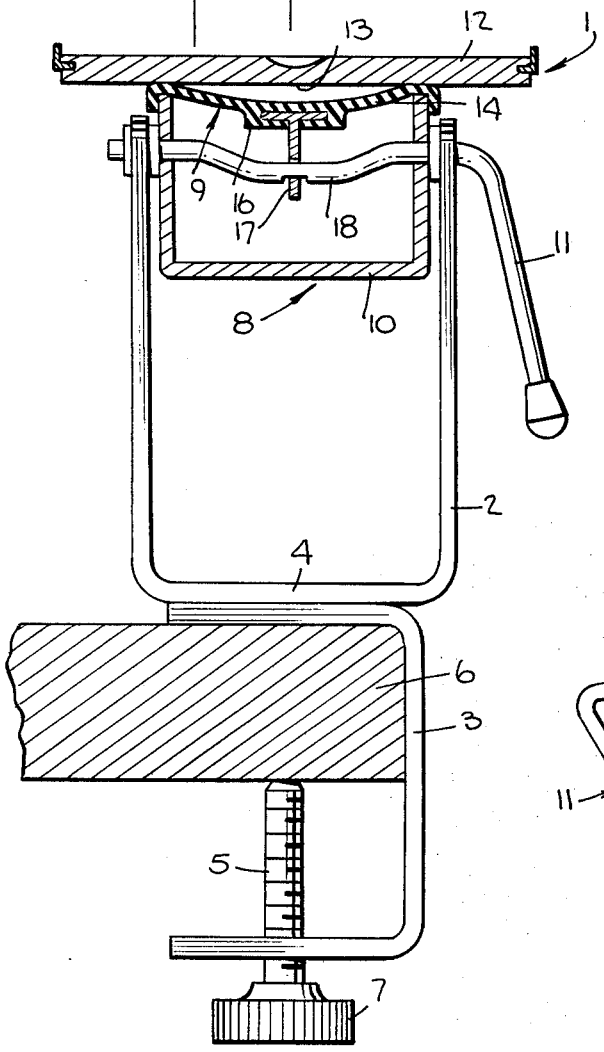
Fig. 2.
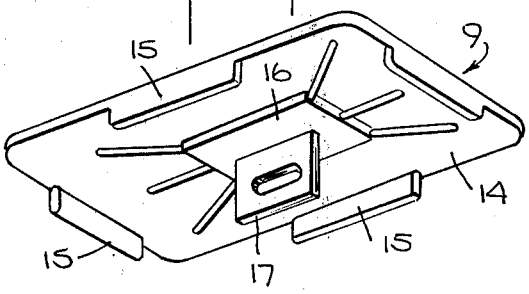
Fig. 3.
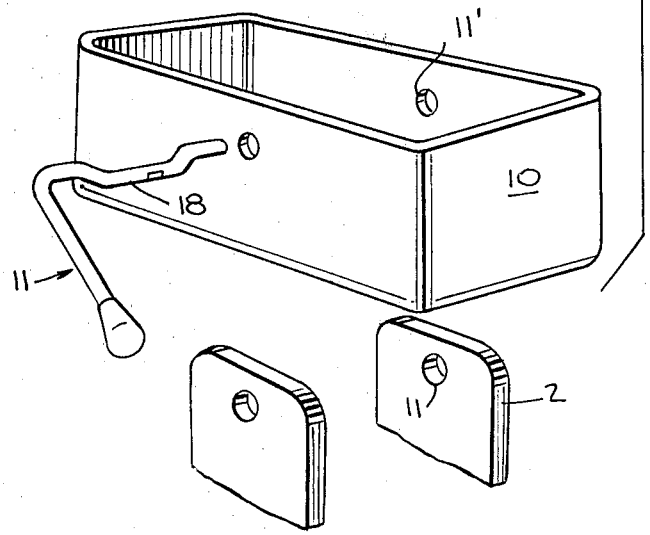

SKI HOLDER

BACKGROUND OF THE INVENTION

The present invention relates to an improved and simplified holder for temporarily mounting skis for routine maintenance such as for tuning the ski surfaces. More particularly, the invention relates to an improved simplified holder for use in pairs for temporarily and releasably mounting a ski on a work table or other convenient surface for the tuning operation.

In order to obtain a satisfactory performance from his skis, a skier must maintain the ski bottom surface and the ski edges in condition with the edges sharp and the bottoms smooth and properly coated. Such maintenance is desirable for each cross country outing and every fifth time or so for downhill skiing. This work is most conveniently done by mounting each ski in an inverted and horizontal position on a work table or other convenient surface. Very often this tuning must be done at the skiing location so that it is desirable to have a satisfactory and easily carried ski holder for use with almost any table or other work surface for the ski tuning.

There are a number of holder or clamping devices which have been suggested or produced for this purpose, however, some of these prior clamps tend to be relatively heavy and complicated so that they are not readily taken to the skiing sites. In other cases they are maintained on temporary work surfaces only with difficulty and fail to provide a suitable firm clamping action.

The ski holder of the present invention provides a lightweight, simple holder adapted for being readily clamped onto a table or other work surface and for being vacuum attached to a ski at the holder top. It is only necessary to use a pair of the holders mounted in spaced relation on the work surface and engaging the ski using the novel vacuum devices for gripping the ski.

Accordingly, an object of the present invention is to provide an improved, lightweight and conveniently set up ski holder which is portable for use, as necessary, at skiing locations and otherwise.

Another object of the present invention is to provide an improved vacuum-type holder for removably mounting skis for ski tuning.

Another object of the present invention is to provide a lightweight, portable and low-cost holder for use in tuning skis.

Other and further objects of the present invention will become apparent upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

FIG. 1 is a perspective view illustrating a pair of holders in accordance with the present invention being used in a typical ski tuning operation.

FIG. 2 is an elevational view, partially in section, of a ski holder in accordance with the present invention.

FIG. 3 is an exploded perspective view of the ski holder illustrating a ski engaging vacuum device.

DESCRIPTION OF THE PREFERRED EMBODIMENT

The preferred embodiment of the holder 1 includes a generally "U" shaped body portion 2 formed from a suitable rigid metal or plastic material. A mounting clamp 3 having a "C" shape is welded or otherwise attached to the bottom 4 of the body portion 2. It includes a threaded screw 5 for attaching the clamp 3 to a table top or other work surface 6. The holder 1 is removably attached to the work surface 6 by tightening the screw 5 by using a knurled knob 7.

A releasable gripping means 8 is mounted at the top of the holder 1 for engaging the top surface of the ski 12 which is being tuned. A preferred ski gripping means 8 is a vacuum device which includes a resilient plastic or rubber vacuum pad 9 mounted on the top of a hollow pad support box 10. The box 10 is pivotally mounted on the body portion 2 by means of a vacuum control handle 11 which passes through spaced apertures 11 at the top of the body portion 2 and 11' in the support box 10.

The vacuum ski gripping force is generated between the surface of the vacuum pad 9 and the relatively flat surface 13 of the ski 12 by means of the vacuum controlled handle 11.

As best illustrated in FIG. 3, the vacuum pad 9 is a unitary molded rubber or plastic resilient member with a main gripping or body portion 14 having positioning flanges 15. A thickened connecting portion 16 has a rigid bearing member 17 embedded therein for connecting the vacuum pad 9 to the crank portion 18 of the control handle 11. While the vacuum pad 9 may be cemented or otherwise fastened to the box 10, the bearing 17 holds the vacuum pad 9 in place on the support box 10 for all positions of the handle 11. When the control handle 11 is turned to a position generally parallel to the ski 12, the bearing member 17 causes the vacuum pad 9 to assume a flat shape corresponding generally to the adjacent surface 13 of the ski 12. When the control handle 11 is swung 90° to a generally vertical position as illustrated in FIG. 2, its crank portion 18 draws the bearing member 17 and the interconnected central portion of the vacuum pad 9 downwardly causing it to assume a concave and vacuum creating shape. In this position, vacuum forces force the ski 12 tightly against the vacuum pad 9 and the holder 1. Two holders 1 mounted on the work surface 6 and spaced at a distance somewhat less than the ski length, as illustrated in FIG. 1, tightly engage the ski 12 for the usual maintenance operations such as scraping, bottom filing, side filing, waxing and binding adjustment operations.

The pivotal mounting of the support box 10 on the control handle 11 permits the vacuum pad 9 to accomodate itself to the normally sloping tops of the ski 12, The above described mounting means comprising two holders 1 is seen to tightly grip the ski 12 without causing any marring or scratching or other defacement from the ski gripping action. Each of the holders 1 is quickly and easily mounted using the preferred threaded clamp or other table engaging means. The body portion 2 of the holder is proportioned to leave clearance for the ski bindings.

The holders 1 are readily attached to both the work surface 6 and to the skis 12 independently of one another and a suitable ski holding system is provided through the use of only two similar holders. The holders 1 themselves are easily packed and carried along with the usual ski equipment and are ready for instant use before or after a day's skiing activity.

The ski engaging vacuum pads 9 are conveniently made somewhat narrower than the skis i.e.; a couple of inches wide, and two or three inches in length and when thus porportioned, provide an adequate gripping force.

The holders 1 provide lightweight, inexpensive and simple but effective means for holding skis in place for necessary routine maintenance proceedures and make it practical for the maintenance proceedures to be performed directly at the ski slope.

As various changes may be made in the form, contruction and arrangement of the parts herein without sacrificing any of its advantages, it is to be understood that all matter herein is to be interpreted as illustrative and not in a limiting sense.

Having thus described our invention, we claim:

1. A portable holder for use in spaced relation with a similar holder as a ski support for releasably engaging a ski for maintenance operations at a work station comprising the combination of:

a holder body portion;

clamping means on said body portion for removably mounting the holder at a work station;

a vacuum ski gripping means comprising a resilient pad and control means for causing the pad to assume an upwardly forcing concave shape;

an open top hollow member mounting said pad;

said control means including a bearing on said pad and a crank operatively coupled to said bearing and pivotally mounted on said hollow member; and said crank pivotally mounting said hollow member on said body portion.

2. The portable holder as claimed in claim 1 in which said resilient pad comprises plastic.

3. The portable holder as claimed in claim 1 in which said resilient pad comprises rubber.

4. The portable holder as claimed in claim 1 in which said clamping means comprises a threaded clamp.

5. A portable holder for use in spaced relation with a similar holder as a ski support for releasably engaging a ski for maintenance operations at a work station comprising the combination of:

a holder body portion;

clamping means positioned on the bottom of said body portion;

a vacuum ski gripping means;

said ski gripping means comprising a resilient pad and control means for causing the pad to assume an upwardly facing concave form;

a control handle for said control means;

said control handle pivotally mounting said vacuum ski gripping means on said body portion and including a crank portion coupled to said resilient pad; and said handle being positioned so that the axis of the pivotal mounting for said vacuum ski gripping means extends laterally of the engaged ski.

* * * * *